US007316590B2

(12) United States Patent
Zueck et al.

(10) Patent No.: US 7,316,590 B2
(45) Date of Patent: Jan. 8, 2008

(54) DATA CONNECTOR WITH CHANGEABLE CONNECTOR KEY AND METHOD OF USING THE SAME

(75) Inventors: Joseph M. Zueck, Carlsbad, CA (US); Michael D. Johnson, Longmont, CO (US); James F. Santospirito, Valley Center, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 11/111,533

(22) Filed: Apr. 21, 2005

(65) Prior Publication Data

US 2006/0240715 A1 Oct. 26, 2006

(51) Int. Cl.
*H01R 13/64* (2006.01)

(52) U.S. Cl. ..... 439/681

(58) Field of Classification Search ..... 439/681, 439/680, 677, 79

See application file for complete search history.

(56) References Cited

U.S. PATENT DOCUMENTS

| | | | | |
|---|---|---|---|---|
| 4,422,706 | A * | 12/1983 | Neuhouser | 439/680 |
| 4,878,858 | A * | 11/1989 | Dechelette | 439/680 |
| 5,370,556 | A * | 12/1994 | Olsson | 439/681 |
| 6,358,089 | B1 * | 3/2002 | Kuroda et al. | 439/680 |

* cited by examiner

*Primary Examiner*—Felix Figueroa

(57) ABSTRACT

An electronic data connector of a wireless communication device for receiving a male section of a different electronic connector includes an electronic data connector receptacle universal to different electronic connectors and having a female section with a recess for receiving the male section of the different electronic connectors. A changeable connector key is carried by the electronic data connector receptacle and includes one or more positive material obstructions that obstruct one or more portions of the recess of the female section so that only an electronic connector with a male section configured to accommodate the positive material obstructions will mate with the electronic data connector receptacle.

14 Claims, 4 Drawing Sheets

DATA CONNECTOR WITH CHANGEABLE CONNECTOR KEY AND METHOD OF USING THE SAME

FIELD OF THE INVENTION

The present invention generally relates, in general, to electronic data connectors for electronic data devices, and, in particular, to electronic data connectors for wireless communication devices.

BACKGROUND OF THE INVENTION

Some wireless carriers are in the process of implementing unique data connector keying for wireless communication device suppliers. When a unique data connector is required, the wireless communication device supplier provides a wireless communication device with a unique data connector for the particular customer. This reduces flexibility on the circuit card assembly ("CCA") as it is then customer specific once the connector is attached to the CCA.

SUMMARY

An aspect of the present invention relates to using a universal connector installed onto the. CCA in the wireless communication device with a later-added unique key that makes the connector unique for a particular wireless carrier, customer, or application (e.g., target market). At the point the decision must be made as to who or what the phone is for, a unique key particular to the wireless carrier, customer, or application is installed into the correct keying position or not at all. If the wireless carrier, customer, or application changes after the wireless communication device is built, then the key can be removed and the wireless communication device with universal connector can be used for another wireless carrier, customer, or application). Further, refurbished units, returned units, and/or excess and obsolete (EAO) end-of-product-life units may have the key replaced with a different key specific to another wireless carrier, customer, or application. Thus, the invention allows a common connector to be used for all wireless communication devices of a particular type or model yet provides keying for specific wireless carriers, customers, or applications.

Another aspect of the invention involves an electronic data connector of a wireless communication device for receiving a male section of a different electronic connector. The electronic data connector includes an electronic data connector universal to different electronic connectors and having a female section with a recess for receiving the male section of the different electronic connectors. A changeable connector key is carried by the electronic data connector and includes one or more positive material obstructions that obstruct one or more portions of the recess of the female section so that only an electronic connector with a male section configured to accommodate the positive material obstructions will mate with the electronic data connector.

A further aspect of the invention involves a method of using a universal electronic data connector of a wireless communication device. The method includes providing a universal electronic data connector of a wireless communication device, the universal electronic data connector universal to different mating electronic connectors and including a female section with a recess for receiving a male section of a mating electronic connector; adding a changeable connector key specific to a male section of a particular mating electronic connector to the universal electronic data connector, the changeable connector key including one or more positive material obstructions; obstructing one or more portions of the recess of the female section with the one or more positive material obstructions of the changeable connector key so that only the male section of the particular mating electronic connector configured to accommodate the positive material obstructions will mate with the universal electronic data connector; and connecting the particular mating electronic connector with the electronic data connector by mating the male section of the particular mating electronic connector configured to accommodate the positive material obstructions with the female section of the electronic data connector.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

With reference to FIGS. 1-6, disclosed herein is an embodiment of a universal electronic data connector receptacle 100 and unique removable, changeable key 110 for a wireless communication device 120. The unique changeable connector key 110 makes the connector receptacle 100 unique for a particular wireless carrier, customer, or application (e.g., target market) so that the wireless communication device supplier can use a universal connector receptacle 100 and circuit card assembly ("CCA") for all wireless carriers, customers, or applications of the particular type or model of wireless communication device 120. If a wireless carrier, customer, or application requires a wireless communication device 120 with a connector unique for the wireless carrier, customer, or application (e.g., unique to the plugs, adapter, and other accessories of the wireless carrier, customer, or application), the unique connector key 110 is added to the universal connector 110 to make the connector receptacle 100 specific to that wireless carrier, customer, or application. This eliminates the need to provide different or surface mounted connectors and CCAs for different wireless carriers, customers, or applications requiring a wireless communication device 120 with a connector unique to the wireless carrier, customer, or application. The addition of the unique connector key 110 to the connector receptacle 100 also eliminates creation of a universally keyed plug that would be able to mate with different connector receptacles.

The invention will be shown in conjunction with a cellular phone; however, the invention may apply to electronic data connectors used in wireless communication devices other than cellular phones. Further, the invention may apply to mechanical and/or electronic connectors used in devices other than wireless communication devices.

Figure 1:
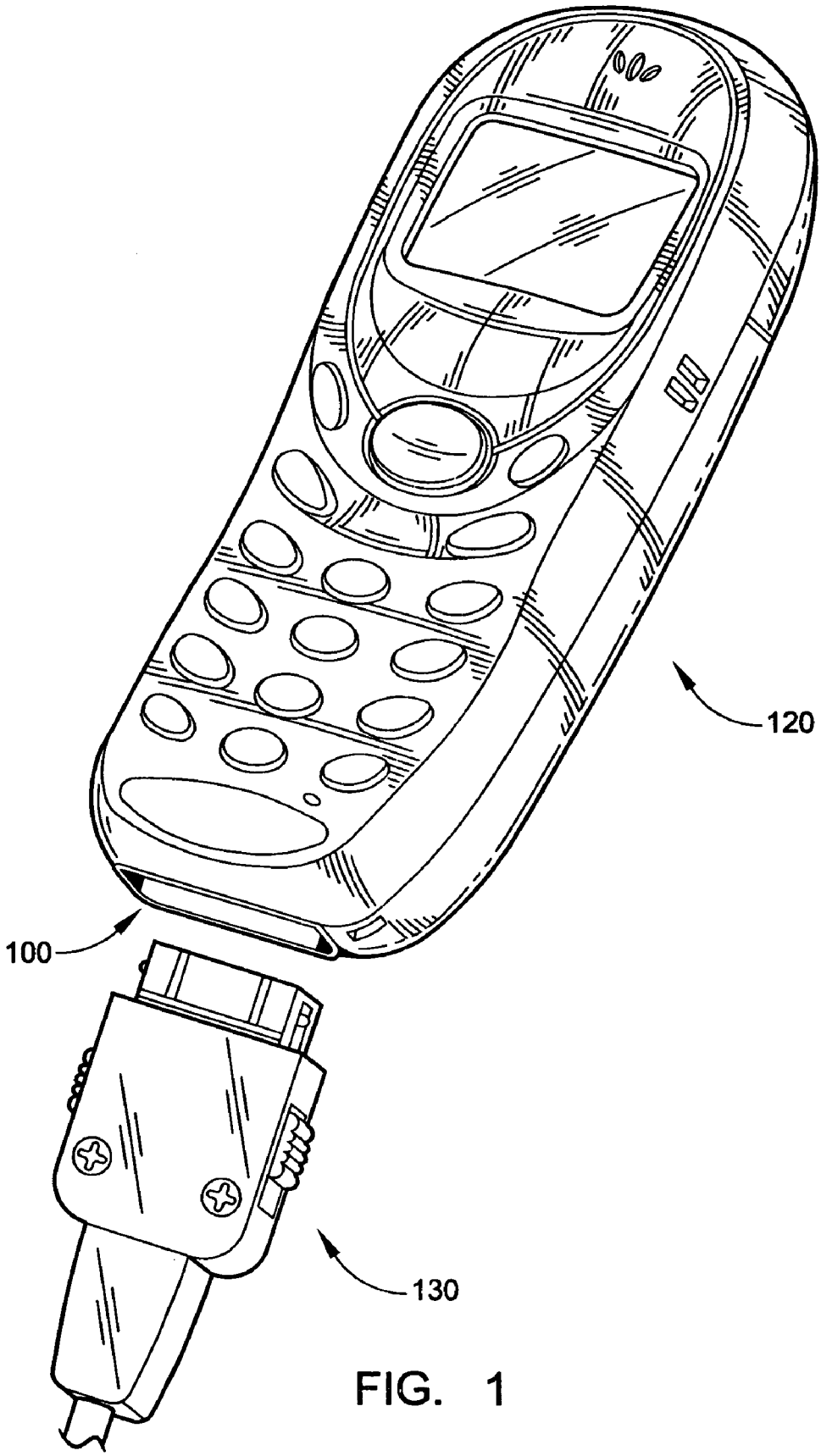
FIG. 1 is a perspective view of an embodiment of a wireless communication device including a universal connector with a unique key particular to the plug or other unique accessories of a wireless carrier, customer, or application.
Figure 3:
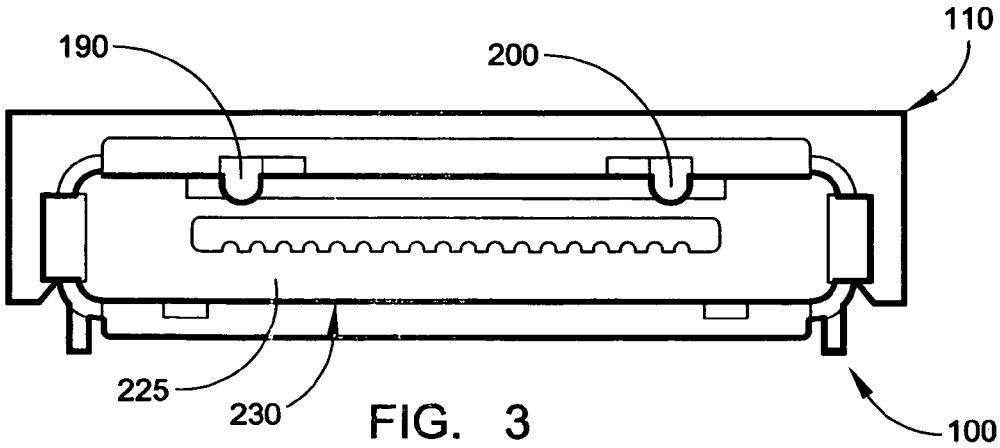
FIG. 3 is a front-elevational view of the connector/key illustrated in FIGS. 2A and 2B.
Figure 4B:
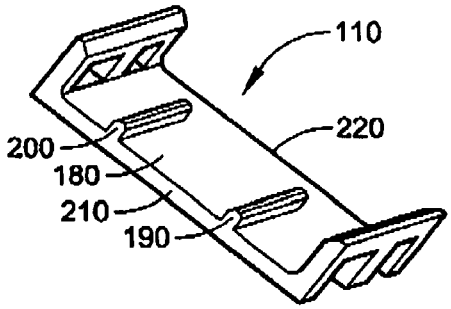
FIG. 4B is a perspective view looking at the bottom of the key illustrated in FIGS. 2A-3.
Figure 4A:
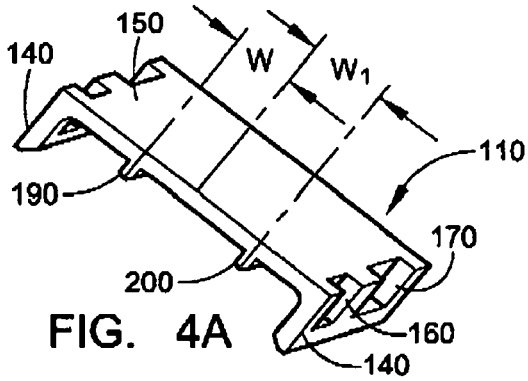
FIG. 4A is a perspective view looking at the top of the key illustrated in FIGS. 2A-3.
Figure 5A:
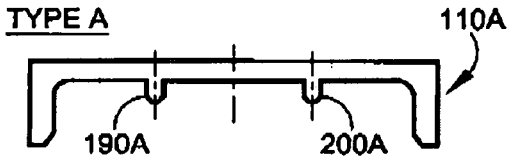
FIGS. 5A-5D are front elevational views of different embodiments of a key for the connector illustrated in FIGS. 2A-3.
Figure 6A:
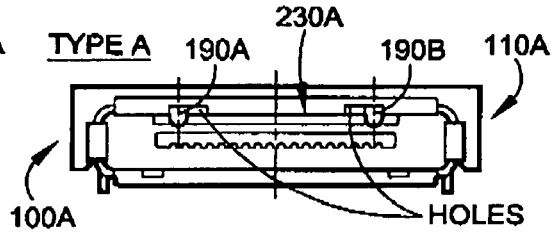
FIGS. 6A-6D are front elevational views of the connector illustrated in FIGS. 2A-3 with the different embodiments of the key from FIGS. 5A-5D shown therein.
Figure 5B:
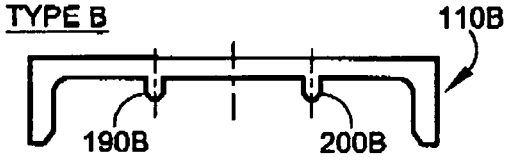
Figure 6B:
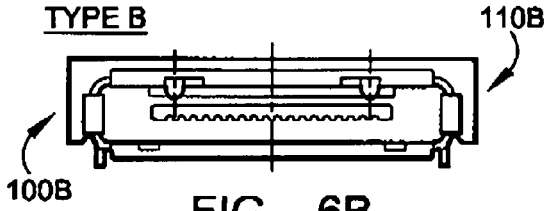
Figure 5C:
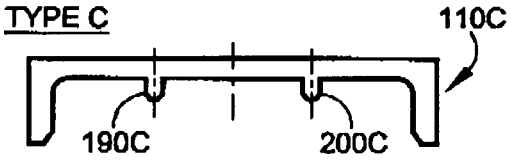
Figure 6C:
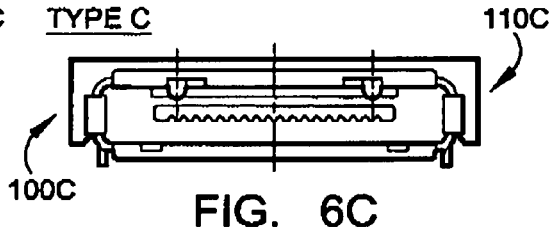
Figure 5D:
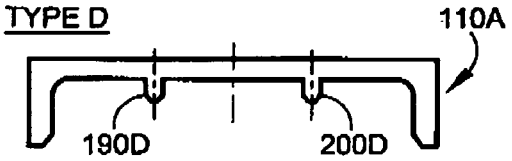
Figure 6D:
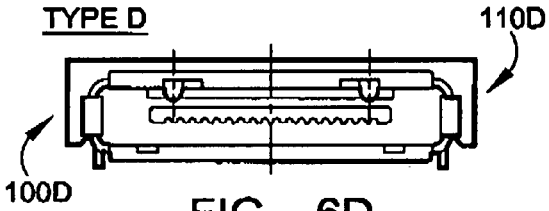

FIG. 1 illustrates an embodiment of a wireless communication device (e.g., cellular phone) 120 with a universal electronic data connector receptacle 100 constructed disposed in a lower end thereof. To assist the reader in gaining a better understanding of the invention, an embodiment of the universal electronic data connector receptacle 100 is shown removed from the bottom of the wireless communication device 120 in FIGS. 2A-3. The unique changeable key 110, which is shown in greater detail in FIGS. 4A and 4B, is added onto the top of the universal connector receptacle 100 to make the connector unique for a particular wireless carrier, customer, or application. In the embodiment shown in FIGS. 1-2B, adding the unique key 110 to the connector receptacle 100 makes the connector receptacle 100 unique to a specific plug 130 of the wireless carrier, customer, or application. This eliminates the need for the wireless communication device supplier to provide different or surface mounted connectors and CCAs for different wireless carriers, customers, or applications requiring a wireless communication device 120 with a connector unique to the wireless carrier, customer, or application.

Figure 2A:
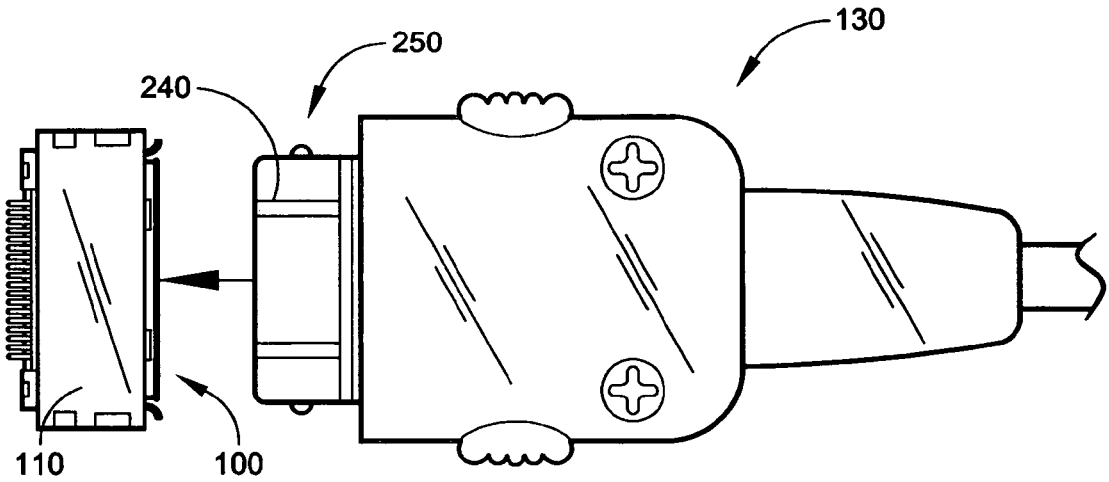
FIG. 2A is a top plan view of an embodiment of the universal connector with a unique key disposed therein and an embodiment of a plug that is specific to the connector and key.
Figure 2B:
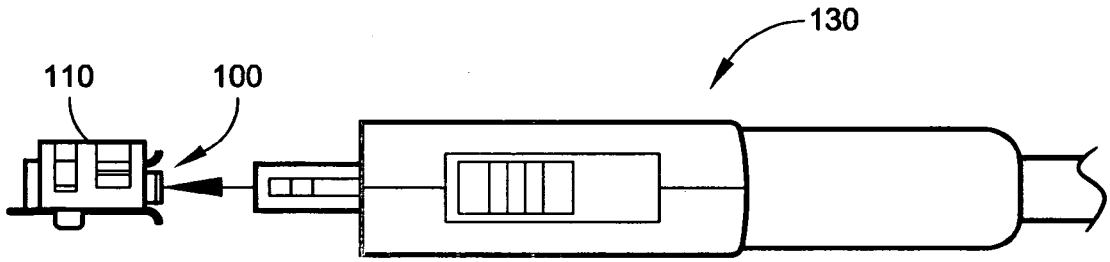
FIG. 2B is a left side-elevational view of the connector/key and plug illustrated in FIG. 2A.

With reference additionally to FIGS. 4A and 4B, an embodiment of the changeable unique key 110 will be described in more detail. The key 110 includes a pair of opposite parallel vertical legs 140 joined at upper ends by a cap plate 150. At the intersection of the legs 140 and the cap plate 150, the key 110 includes a first, narrow recess 160, and a second, wide recess 170. An underside 180 of the cap plate 150 includes a first protrusion 190 located at a distance w left of a longitudinal center of the key 110, and a second protrusion 200 located at a distance $w_1$ right of the longitudinal center of the key 110. In the embodiment shown, the protrusions 190, 200 are narrow rails extending along the underside 180 of the cap plate from a front 210 of the key 110 to a point short of a rear 220 of the key 110. When the key 110 is disposed on the connector receptacle 100, as shown in FIG. 2A-3, the protrusions 190, 200 form positive material barriers or obstructions in a female recess 225 of a female connector section (or receptacle section) 230. The protrusions 190, 200 have a unique configuration and location on the key 110 so that grooves 240 (FIG. 2A) on male section 250 of the plug 130, which are configured to accommodate the protrusions 190, 200, operably mate therewith when the male section 250 of the plug 130 is inserted into the female section 230 of the connector receptacle 100.

FIGS. 5A-5D illustrate four different embodiments of a key: 110A, 110B, 110C, 110D. For example, the key 110A includes a first, left protrusion 190A located at a distance w of 4.0 mm left of center and a second, right protrusion 200A located at a distance $w_1$ of 4.0 mm right of center. The key 110B illustrated in FIG. 5B includes a first, left protrusion 190B located at a distance w of 3.25 mm left of center and a second, right protrusion 200B located at a distance $w_1$ of 3.25 mm right of center. The key 110C illustrated in FIG. 5C includes a first, left protrusion 190C located at a distance $w_1$ of 4.0 mm left of center and a second, right protrusion 200C located at a distance $w_1$ of 3.25 mm right of center. The key 110D illustrated in FIG. 5D includes a first, left protrusion 190D located at a distance w of 3.25 mm left of center and a second, right protrusion 200D located at a distance $w_1$ of 4.0 mm right of center.

FIGS. 6A-6D illustrate four different embodiments of the same universal connector receptacle 100 when the respective different keys 110A-110D are added thereto. For example, the connector receptacle 100A illustrated in FIG. 6A includes the key 110A of FIG. 5A. In this embodiment, the protrusions 190A, 200A form positive material barriers or obstructions in female section 230A of the connector receptacle 100A. The connector receptacle 100B illustrated in FIG. 6B includes the key 110B of FIG. 5B. The connector receptacle 100C illustrated in FIG. 6C includes the key 110C of FIG. 5C. The connector receptacle 100D illustrated in FIG. 6D includes the key 100D of FIG. 5D. In the embodiments of the connector receptacle 100A-100D shown in FIGS. 6A-6D, the same universal connector receptacle 100 may be specifically adapted using the keys 110A-100D for four different wireless carriers, customers, or applications. Further, the connector receptacle 100 may used without the key 110. Thus, in the embodiment shown in FIGS. 6A-6D, the single universal connector receptacle 100 may be specifically adapted for five different wireless carriers, customers, or applications.

Figure 7:
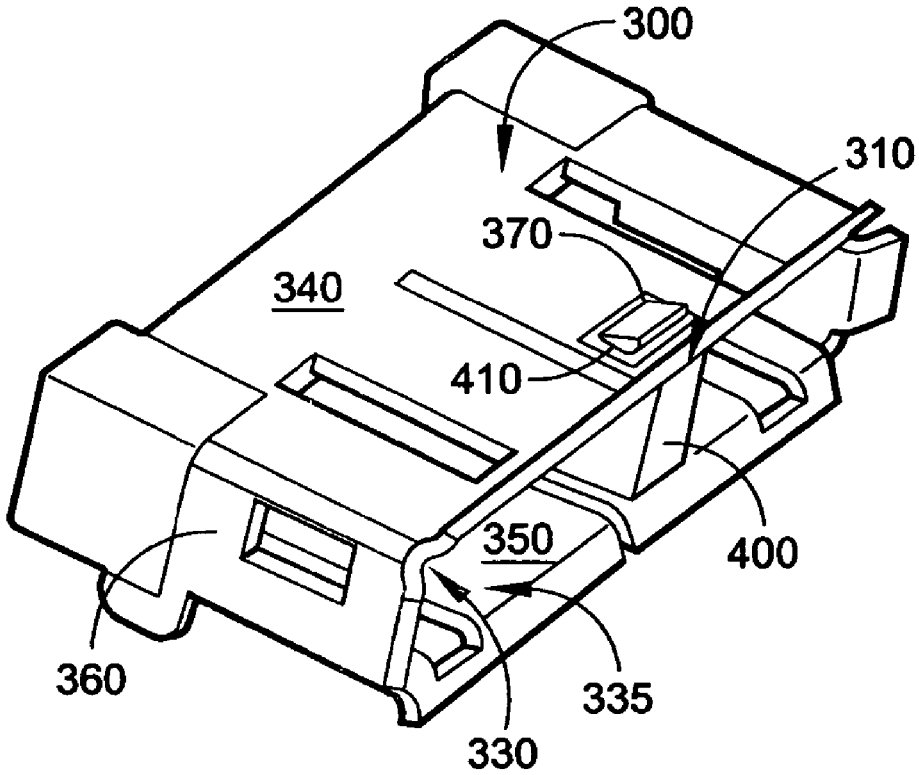
FIG. 7 is a perspective view of another embodiment of a universal connector with a unique key particular to the plug or other unique accessories of a wireless carrier, customer, or application.

With reference to FIG. 7, another embodiment of a universal connector receptacle 300 and key 310 for a wireless communication device will be described. The connector receptacle 300 includes a female section 330 including a female recess 335, a top wall 340, a bottom wall 350, and side walls 360. The top wall 340 and bottom wall 350 include rectangular slots 370.

Figure 8:
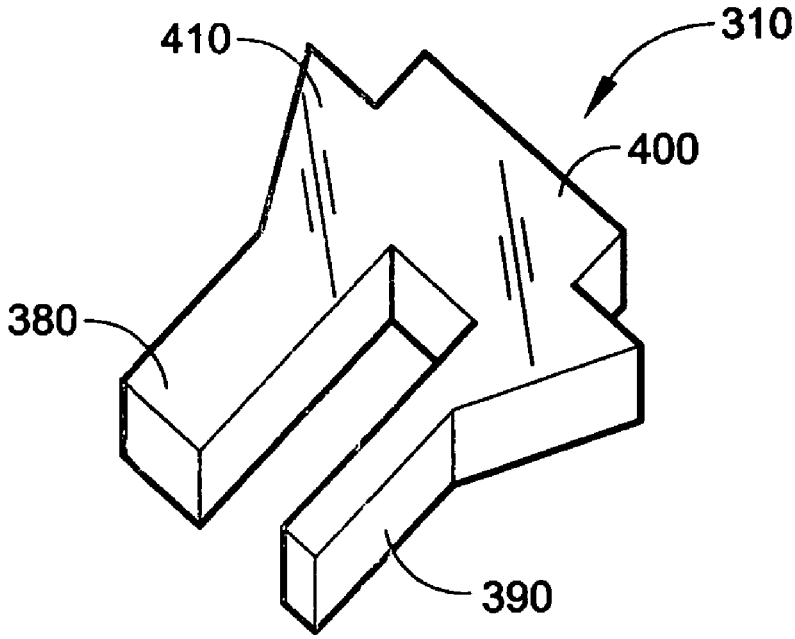
FIG. 8 is a perspective view of the key illustrated in FIG. 7.

With reference to FIG. 8, the key 310 includes a first wide leg 380, a separated second narrow leg 390, a rectangular protrusion 400 connecting the ends of legs 380, 390, and opposite angled catches 410.

The key 310 is inserted into the female section 330 of the connector receptacle 300 so that the opposite angled catches 410 are retained within the rectangular slots 370 of the top wall 340 and bottom wall 350, and the rectangular protrusion 400 blocks a portion of the open-end of the female recess 335 of female section 330. When the key 310 is disposed in the connector receptacle 300, as shown in FIG. 7, the protrusion 400 forms a positive material barrier or obstruction in a select portion of the female recess 335 of the female section 330 of the connector receptacle 300. A corresponding plug (not shown) would include a recess on a male section of the plug that operably mates with the protrusion 400 when the male section of the plug is inserted into the female section 330 of the connector receptacle 300 to join the plug and the connector. Different keys with different configurations may be inserted into the female section 330 of the connector receptacle 300 and retained in the slots 370 so that the same universal connector receptacle 300 may be configured using the different keys, to be specific to different wireless carriers, customers, or applications. Alternatively, the connector receptacle 300 may include the slots 370 at different lateral locations so that positioning the key 310 at different lateral locations configures the connector receptacle 300 for different wireless carriers, customers, or applications.

In alternative embodiments, the universal connector receptacle may include other types of positive material changeable, replaceable keys to selectively block one or more portions of the female recess to make the connector unique for a particular wireless carrier, customer, or application. For example, but not by way of limitation, the key may be configured to block one or more portions adjacent the sides of the universal connector receptacle. In such an embodiment, the key may be carried by a side of the universal connector receptacle. It is important to selectively block one or more portions of the female recess with the key (compared to adding further voids, spaces, or recesses in the female section of the connector) because the former necessitates a unique plug design where with the latter a universally keyed plug or universal plug may work with different connectors.

Using the universal connector receptacle 100, 300 with a later-added unique key 110, 310 makes the connector receptacle 100, 300 unique for a particular wireless carrier, customer, or application. At the point the decision must be made as to who or what the phone is for, a unique key particular to that wireless carrier, customer, or application is installed into the correct keying position or not at all. If the wireless carrier, customer, or application changes after the wireless communication device is built, then the key is replaced with a different key (or no key), and the wireless communication device with universal connector and new key (or no key) can be used for another wireless carrier, customer, or application. Thus, the universal connector receptacle and changeable unique key allows a common connector to be used for all wireless communication devices (or all wireless communication devices of a certain type or model) yet provide keying for specific wireless carriers, customers, or applications.

While the particular devices and methods herein shown and described in detail are fully capable of attaining the above described objects of this invention, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art having the benefit of this disclosure and that the scope of the present invention is accordingly limited by nothing other than the appended claims.

What is claimed is:

1. An electronic data connector of a wireless communication device for receiving a male section of a different electronic connector, comprising:

an electronic data connector receptacle generic to different electronic connectors, the electronic data connector receptacle including a female section with a recess for receiving the male section of the different electronic connectors the female section including a top with holes therein having a width perpendicular to an insertion direction of the male section;

a removably attachable connector key carried by the electronic data connector receptacle and including one or more positive material obstructions extending partially through the holes into the recess of the female section having a width that obstruct one or more portions of the recess of the female section so that only an electronic connector with a male section configured to accommodate the positive material obstructions will mate with the electronic data connector receptacle, wherein the removably attachable connector key is disposed substantially outside of the female section and covers entire top and sides of the female section, and the width of each of the positive material obstructions is ½ the width of each of the holes in the top of the female section.

2. The electronic data connector of claim 1, wherein the one or more positive material obstructions include a pair of protrusions extending partially into a top of the recess of the female section.

3. The electronic data connector of claim 2, wherein the removably attachable connector key includes a longitudinal center and each protrusion is spaced a predetermined distance from the longitudinal center.

4. The electronic data connector of claim 1, wherein the one or more positive material obstructions include a pair of narrow rails extending partially into a top of the recess of the female section.

5. The electronic data connector of claim 1, wherein the electronic data connector receptacle includes a top, the removably attachable connector key is carded by the top of the electronic data connector receptacle, and the one or more positive material obstructions include a pair of protrusions extending downwardly from the top of the electronic data connector receptacle, partially into a top of the recess of the female section.

6. The electronic data connector of claim 1, wherein the electronic data connector receptacle includes a top and opposite sides, the removably attachable connector key includes opposite vertical legs joined by a cap plate, the cap plate of the removably attachable connector key is carried by the top of the electronic data connector receptacle, the opposite vertical legs of the removably attachable connector key straddle the sides of the electronic data connector receptacle, and the one or more positive material obstructions include a pair of narrow rails extending downwardly from the top of the electronic data connector receptacle, partially into a top of the recess of the female section.

7. The electronic data connector of claim 1, wherein the removably attachable connector key is one of multiple removably attachable connector keys having different positive material obstructions.

8. A method of using a generic electronic data connector of a wireless communication device, comprising:

providing a generic electronic data connector receptacle of a wireless communication device, the generic electronic data connector receptacle generic to different mating electronic connectors and including a female section with a recess for receiving a male section of a mating electronic connector, the female section including a top with holes therein having a width perpendicular to an insertion direction of the male section;

adding a removably attachable connector key specific to a male section of a particular mating electronic connector to the generic electronic data connector receptacle so that the removably attachable connector key is disposed substantially outside of the male section receiving recess and covers entire top and sides of the female section, the removably attachable connector key including one or more positive material obstructions extending partially through the holes into the recess of the female section and each having a width that is ½ the width of each of the holes in the top of the female section;

obstructing one or more portions of the recess of the female section with the one or more positive material obstructions of the removably attachable connector key so that only the male section of the particular mating electronic connector configured to accommodate the positive material obstructions will mate with the generic electronic data connector receptacle;

connecting the particular mating electronic connector with the electronic data connector receptacle by mating the male section of the particular mating electronic connector configured to accommodate the positive material obstructions with the female section of the electronic data connector receptacle.

9. The method of claim 8, wherein the one or more positive material obstructions include a pair of protrusions extending partially into a top of the recess of the female section, and obstructing includes obstructing one or more portions of the recess of the female section with the pair of protrusions.

10. The method of claim 9, wherein the removably attachable connector key includes a longitudinal center and each protrusion is spaced a predetermined distance from the longitudinal center.

11. The method of claim 8, wherein the one or more positive material obstructions include a pair of narrow rails extending partially into a top of the recess of the female section, and obstructing includes obstructing one or more portions of the recess of the female section with the narrow rails.

12. The method of claim 8, wherein the electronic data connector receptacle includes a top, the removably attachable connector key is carried by the top of the electronic data connector receptacle, and the one or more positive material obstructions include a pair of protrusions extending downwardly from the top of the electronic data connector receptacle, partially into a top of the recess of the female section, and obstructing includes obstructing one or more portions of the recess of the female section with the pair of protrusions.

13. The method of claim 8, wherein the electronic data connector receptacle Includes a top and opposite sides, the removably attachable connector key includes opposite vertical legs joined by a cap plate, the cap plate of the removably attachable connector key is carried by the top of the electronic data connector receptacle, the opposite vertical legs of the removably attachable connector key straddle the sides of the electronic data connector receptacle, and the one or more positive material obstructions include a pair of narrow rails extending downwardly from the top of the electronic data connector receptacle, partially into a top of the recess of the female section, and obstructing includes obstructing one or more portions of the recess of the female section with the narrow rails.

14. The method of claim 8, wherein the removably attachable connector key is one of multiple removably attachable connector keys having different configurations, and the method further includes removing the removably attachable connector key from the electronic data connector receptacle, and replacing the changeable connector key with a removably attachable connector key having a different configuration.

* * * * *